US008714883B2

(12) United States Patent
Rataj

(10) Patent No.: US 8,714,883 B2
(45) Date of Patent: May 6, 2014

(54) FRICTION BOLT

(75) Inventor: Mieczyslaw Rataj, Charlestown (AU)

(73) Assignee: Sandvik Intellectual Property AB, Sandviken (SE)

( * ) Notice: Subject to any disclaimer, the term of this patent is extended or adjusted under 35 U.S.C. 154(b) by 17 days.

(21) Appl. No.: 13/255,624

(22) PCT Filed: Mar. 9, 2010

(86) PCT No.: PCT/SE2010/050262

§ 371 (c)(1), (2), (4) Date: Mar. 7, 2012

(87) PCT Pub. No.: WO2010/104460

PCT Pub. Date: Sep. 16, 2010

(65) Prior Publication Data

US 2012/0163924 A1 Jun. 28, 2012

(30) Foreign Application Priority Data

Mar. 10, 2009 (AU) ..... 2009901030
Mar. 10, 2009 (AU) ..... 2009901031

(51) Int. Cl.
*E21D 21/00* (2006.01)
*E21D 20/02* (2006.01)

(52) U.S. Cl.
USPC ..... 405/259.3; 405/259.4; 405/259.5; 405/302.2

(58) Field of Classification Search
USPC ..... 405/259.1, 259.3, 259.4, 302.2, 259.5
See application file for complete search history.

(56) References Cited

U.S. PATENT DOCUMENTS 3,683,741 A * 8/1972 Pete ..... 405/259.3
3,940,941 A * 3/1976 Libert et al. ..... 405/259.6

(Continued)

FOREIGN PATENT DOCUMENTS

AU 199852856 B2 8/1998
CA 2186672 9/1996

(Continued)

OTHER PUBLICATIONS

International Search Report issued on Jun. 9, 2010 in International Application No. PCT/SE2010/050262 filed Mar. 9, 2010.

(Continued)

*Primary Examiner* — Frederick L Lagman
(74) *Attorney, Agent, or Firm* — Morgan, Lewis & Bockius LLP

(57) ABSTRACT

A friction bolt, for frictionally engaging the internal surface of a bore drilled into a rock face. The friction bolt comprises an elongate, generally circular tube which is expandable radially. The tube has a leading end and a trailing end. An expander mechanism is disposed within the tube for applying a load tending to expand at least a section of the tube radially. An elongate tendon is disposed longitudinally within the tube and in connection at or towards one end of the tendon with the expander mechanism and in connection at or towards an opposite end of the tendon with an anchor arrangement. The tendon is actuatable to expand the expander mechanism and to remain connected between the expander mechanism and the anchor arrangement while the expander mechanism is expanded. The expander mechanism comprises a pair of expander elements, a first of which is secured relative to the tube and a second of which is secured to the elongate tendon, actuation of the tendon being operable to cause relative movement between the first and second expander elements to cause the expander mechanism to expand.

29 Claims, 6 Drawing Sheets

(56) References Cited

U.S. PATENT DOCUMENTS

| | | | | |
|---|---|---|---|---|
| 4,112,813 | A | 9/1978 | Kuhlmann et al. | |
| 4,226,559 | A * | 10/1980 | Prebensen | 405/303 |
| 4,312,604 | A * | 1/1982 | Fu et al. | 405/259.3 |
| 4,519,735 | A * | 5/1985 | Machtle | 405/259.3 |
| 4,592,687 | A * | 6/1986 | Piersall | 405/259.3 |
| 4,859,118 | A * | 8/1989 | Schaeffer | 405/259.3 |
| 4,898,505 | A * | 2/1990 | Froehlich | 411/55 |
| 5,192,146 | A * | 3/1993 | Landsberg | 405/259.1 |
| 5,295,768 | A * | 3/1994 | Buchhorn et al. | 405/259.3 |
| 5,649,790 | A * | 7/1997 | Mergen et al. | 405/259.3 |
| 5,931,606 | A * | 8/1999 | Karlsen | 405/259.3 |
| 6,244,787 | B1 * | 6/2001 | Seegmiller | 405/302.2 |
| 7,367,751 | B2 * | 5/2008 | Vosbikian | 405/259.3 |
| 7,465,128 | B2 * | 12/2008 | Bruneau | 405/259.3 |
| 7,891,911 | B2 | 2/2011 | Tschernuth et al. | |
| 2007/0009330 | A1 * | 1/2007 | Locotos | 405/259.5 |
| 2007/0196183 | A1 * | 8/2007 | Valgora | 405/259.3 |
| 2008/0236898 | A1 * | 10/2008 | Walker et al. | 175/293 |
| 2011/0135402 | A1 * | 6/2011 | Leppanen | 405/259.3 |

FOREIGN PATENT DOCUMENTS

| | | |
|---|---|---|
| CL | 199601669 | 9/1996 |
| CL | 199800253 | 2/1998 |
| CL | 199801195 | 5/1998 |
| CL | 200502420 | 9/2005 |
| CL | 200702372 | 8/2007 |
| CN | 2216590 | 1/1996 |
| GB | 775040 | 5/1957 |
| GB | 861685 | 2/1961 |
| WO | WO 98/57035 | 12/1998 |
| WO | WO 2006/034208 | 3/2006 |

OTHER PUBLICATIONS

Official Action for Chilean Patent Application No. 2011-002241 dated Oct. 8, 2013.

* cited by examiner

FRICTION BOLT

CROSS REFERENCE TO RELATED APPLICATIONS

This application is a §371 National Stage Application of PCT International Application No. PCT/SE2010/050262, filed Mar. 9, 2010, and claims priority under 35 U.S.C. §119 and/or §365 to Australian Application No. 2009901031 filed Mar. 10, 2009 and Australian Application No. 2009901030 filed Mar. 10, 2009.

TECHNICAL FIELD

The present invention relates to a rock bolt for use in rock strata for the purpose of stabilising the strata against fracture or collapse. The present invention is concerned principally with friction rock bolts which are known in the industry as "split sets" or "friction stabilisers". This form of rock bolt consists of a steel tube that is split longitudinally and which is forced into a bore drilled into rock strata, so that the external surface of the tube frictionally engages the internal surface of the bore. Thus, the tube is frictionally anchored within the bore.

BACKGROUND TO THE INVENTION

Rock bolts of the above kind are very popular in underground mining sites throughout the world, because their installation is very simple when compared to other types of rock bolts. All that is required to install such a rock bolt is to drill a bore into the rock strata and then to hammer the rock bolt into the bore. In contrast, other forms of rock bolts employ resin or grout to anchor the rock bolt within the bore. In respect of resin anchored bolts, a resin cartridge is usually employed, which is required to be inserted into the bore prior to the bolt being inserted therein. Insertion of the resin cartridge is sometimes very difficult, because typically the tunnel walls extend to a significant height, so that access to bores into which the cartridge is to be inserted is inconvenient. Additionally, the resin which is employed is relatively expensive and has a limited shelf life.

Cement grouted rock bolts are less expensive than resin anchored bolts, but application of the cement is more cumbersome than that of the resin. Cement grouting requires cement mixing equipment, as well as pumping and delivery equipment, to deliver the mixed cement into the bore.

Despite the installation difficulties of resin and cement anchoring, bolts anchored in either manner generally are much more efficient in respect of rock reinforcement or stabilisation, because such bolts have a significantly better bond between the resin or cement and the bore wall, compared to the frictional engagement of a friction rock bolt. Accordingly, it is usually necessary to employ a greater number of friction rock bolts than compared to resin or cement grouted bolts, or alternatively, the friction rock bolts are required to be longer than resin or cement grouted bolts.

There are other drawbacks associated with the use of friction bolts, such as:

relatively poor shear strength;

sensitivity to corrosion; and limited ability to support a rock plate against a rock face.

To overcome some of the drawbacks described above, friction bolts are often post grouted after installation. Advantageously, post grouting increases shear strength and protects against corrosion. It is also possible to reinforce a friction rock bolt with a steel bar or cable in addition to post grouting.

In an installation of this kind, the bar or cable is pushed inside the tube of the friction rock bolt immediately after the cement grout has been pumped in. While each of the above modifications to the traditional friction rock bolt improves the performance of the bolt, it will be appreciated that they also significantly add to the installation time and expense of the rock bolt. For example, post grouting can be a difficult process, given that typically grout is introduced through a grout hose, the end of which is fed to the leading end of the rock bolt, whereafter the hose is withdrawn through the length of the rock bolt as grout is pumped into the rock bolt. If withdrawal of the hose is made too quickly, voids can form inside the tube. Moreover, if the grout mixture is too thin, then the grout can flow out of the trailing end of the tube and not fill it. Additionally, it is not always apparent to the operator that enough grout has been pumped in to fill the tube because the existing arrangements do not necessarily provide for an indication that the tube has been filled. Operator experience is therefore critical to correct grouting.

It is an object of the present invention to overcome or at least alleviate one or more of the drawbacks associated with prior art friction rock bolt arrangements.

DISCLOSURE OF THE INVENTION

According to the present invention there is provided a friction bolt, for frictionally engaging the internal surface of a bore drilled into a rock face, the friction bolt comprising an elongate, generally circular tube which is expandable radially, the tube having a leading end and a trailing end, an expander mechanism disposed within the tube for applying a load tending to expand at least a section of the tube radially, an elongate tendon disposed longitudinally within the tube and in connection at or towards one end of the tendon with the expander mechanism and in connection at or towards an opposite end of the tendon with an anchor arrangement, the tendon being actuatable to expand the expander mechanism and to remain connected between the expander mechanism and the anchor arrangement while the expander mechanism is expanded, the expander mechanism comprising a pair of expander elements, a first of which is secured relative to the tube and a second of which is secured to the elongate tendon, actuation of the tendon being operable to cause relative movement between the first and second expander elements to cause the expander mechanism to expand.

A friction bolt according to the present invention can advantageously enable a more firm or secure engagement between the friction bolt and the internal surface of the bore into which the bolt is inserted compared to some other known rock bolts. Moreover, the inclusion of an elongate tendon within the tube can increase both the shear and tensile strength of the friction bolt, particularly if the tendon is a rigid tendon, such as a metal bar, rod or rigid cable. Thus, the tendon can be a rigid tendon, such as a metal bar, rod or rigid cable, a cable which is not rigid, or it can be a hollow bar.

In addition, because such friction bolts are normally employed with a rock plate, the arrangement of the present invention can be such that where the rock supported by the friction bolt fractures and loads the rock plate, the plate can be arranged to cause further actuation of the tendon so that the expander mechanism is further expanded to increase the frictional engagement between the tube and the internal surface of the bore. Thus, a friction bolt according to the invention can be arranged to increase the frictional engagement between itself and the internal surface of the bore upon failure or fracture of the rock strata, in circumstances in which some prior art friction bolts would be pulled either partially or fully from the bore. Thus, a friction bolt according to the present invention is expected to provide improved confidence against release from the bore in circumstances in which the rock strata supported by the friction bolt fractures or fails.

In a friction bolt according to the invention, the tube can be split longitudinally, along at least a portion of its length, but preferably fully along its length. The split is provided principally to facilitate radial contraction of the tube so that the bore into which the tube is inserted can be drilled to have an internal diameter which is slightly less than the external diameter of the tube. In this arrangement, the friction bolt is forced into the bore, such as by a percussion hammer, with the tube contracting radially by closure of the longitudinal split. The natural resilience of the tube is such as to cause the tube to frictionally engage the bore wall. The external surface of the tube thus engages the bore wall frictionally upon insertion and prior to any expansion of the expander mechanism. Expansion of the expander mechanism might result in either no radial expansion of the tube, or negligible expansion, but rather, the action of the expander mechanism is to increase the frictional engagement between the external surface of the tube and the internal surface of the bore.

The split can also facilitate radial expansion of the tube but that is not normally required.

In a friction bolt according to the invention in which the tube includes a longitudinal split, an elongate, generally circular internal sleeve can be disposed within the tube and in resting engagement against the internal surface of the tube. In this arrangement, the internal sleeve bridges or overlies the longitudinal split and extends for substantially the length of the split.

The internal sleeve can be closed longitudinally, so that it can be circular, or it can include an adjustment portion along at least a portion of its length, but preferably its full length, to allow it to contract and expand radially. That enables the internal sleeve to contract with the tube if the tube is required to contract for insertion into a bore, and further enables the sleeve to thereafter expand if necessary, when the expander mechanism is actuated to expand. The expansion portion can be located at the split in the tube.

In the above arrangement, the adjustment portion of the internal sleeve can be an inwardly extending portion which can be V-shaped. In that arrangement, the inwardly extending portion can compress or deepen for radial contraction and can expand or shallow out for radial expansion.

Alternatively, the internal sleeve can be split longitudinally along its length to define a longitudinal gap that can open and close with expansion and contraction of the tube. If this form of internal sleeve is employed, the split of the internal sleeve can be offset from the split of the tube (if provided) and the respective splits can be approximately diametrically opposed.

It is to be noted that the internal sleeve can be employed with a longitudinally closed tube as well as a tube which is longitudinally split. The use of an internal sleeve with a longitudinally closed tube will provide advantages for protection of the tendon located within the tube from the effects of water or moisture penetration. For example, the tube of a friction bolt according to the invention can corrode if made out of a corrodible material and if the corrosion is such as to penetrate through the full thickness of the tube wall, then the tendon inside the tube will be exposed to water or moisture from the surrounding rock strata. Accordingly, the employment of an internal sleeve can act as a barrier to water and moisture penetration into the interior of the tube, despite any serious corrosion that might occur through the thickness of the tube. It follows that an internal sleeve can be used either with or without post grouting as will be described later herein.

The internal sleeve can be formed of a plastic material, although other materials could be employed, such as flexible metal sheet, or rubber.

A friction bolt according to the invention can be post grouted and the employment of a plastic sleeve which bridges or overlies the longitudinal split can prevent escape of the grouting medium from within the interior of the tube, but still allow for contraction and expansion of the tube as required during installation of the tube and prior to post grouting. In addition, while the inclusion of grout can itself protect the tendon from corrosion, the grout will usually crack under pressure from the rock strata, so that water or moisture can access the tendon through the cracks. Thus, the inclusion of a sleeve can prevent this access.

In an alternative arrangement, the tube of the friction bolt is closed longitudinally and includes an adjustment portion for at least a portion of its length, but preferably fully along its length, so as to permit radial expansion and contraction of the tube, as required for insertion of a friction bolt within a bore and for any later expansion of the tube under the influence of the expander mechanism. The adjustment portion can be of the same or similar kind discussed above in relation to the internal sleeve, so that the adjustment portion can comprise an inwardly extending portion which can be formed for example, in a V-shape so that it can contract or expand during radial contraction or expansion of the tube.

Where the tube is closed longitudinally, an opening can be provided in the tube to facilitate assembly of the expander mechanism within the tube. For example, the expander mechanism could comprise a pair of wedges, one of which is fixed to the internal surface of the tube and the other of which is fixed to the elongate tendon. Thus, an opening can be provided through the wall of the tube to enable one of the wedges to be fixed to the tube surface, such as by welding.

As indicated above, the expander mechanism can comprise a pair of expander elements, a first of which is secured relative to the tube in any suitable manner, such as welding or by a screw fastener, and a second of which is secured to the elongate tendon, such as by welding, threaded engagement or other fastening mechanism such as a barrel and wedge arrangement, or by a pin. Actuation of the tendon can be such as to cause relative movement between the first and second expander elements to cause the expander mechanism to expand. The first and second expander elements can be wedge elements such that relative linear movement between the elements causes expansion or contraction, depending on the direction of relative movement.

Other forms of expander mechanisms can be employed as suitable for a rock bolt according to the present invention.

It is preferred that the expander mechanism be disposed toward the leading end of the tube, preferably at or very close to the leading end. In a preferred arrangement, the leading tip of the tube is tapered to facilitate insertion of the friction bolt into a bore, and the expander mechanism is disposed immediately adjacent to the tapered portion.

In some arrangements, the anchor comprises a nut which is threadably engaged with the elongate tendon and the anchor further comprises an abutment against which the nut abuts. The nut can be any suitable form of nut such as a hex nut or a wing nut. In this arrangement, either of the tendon or the nut can be rotated relative to the other to actuate the tendon to expand the expander mechanism. In one arrangement, it is the nut that is rotated and by rotation in one direction, the tendon is retracted in a direction away from the leading end of the tube to actuate the expander mechanism. Alternatively, the anchor can be of a barrel and wedge arrangement and actuation of the expander mechanism is by pulling the tendon through the barrel and wedge arrangement, with the barrel and wedge arrangement holding the position of the tendon. This latter arrangement is particularly suited to tendons in the form of cables.

In an alternative arrangement, the anchor can comprise a nut which is fixed to the tendon so that rotation of the nut rotates that tendon. The nut is thus employed for engagement by a suitable tool, a spanner or wrench for example, so that the tendon can be rotated. In this arrangement, rotation of the tendon actuates the expander mechanism and this can be through threaded engagement between the tendon and the expander mechanism.

The nut can be fixed to the tendon in any suitable manner, such as by welding or crimping. Alternatively, a pin can be inserted through the nut and the tendon, or the nut can be a blind nut. Still further, the nut can be formed integrally with the tendon, such as by forging.

In an expander mechanism which comprises a pair of wedge elements, the tendon is connected to one of the wedge elements to move that element relative to the other of the wedge elements. In an arrangement in which the anchor comprises a nut which is threadably engaged with the tendon, rotation of the nut in one direction will retract the tendon which will consequently retract one of the wedge elements relative to the other thereby causing expansion of the expander mechanism. Rotation of the nut in the opposite direction will cause the expander mechanism to be contracted. By this arrangement, the expander mechanism can be contracted if the friction bolt is to be removed from within a bore. This can occur particularly if the friction bolt is inserted into a bore which is of greater diameter than the external diameter of the tube of the bolt. In that arrangement, the bolt frictionally engages the bore wall only upon expansion of the expander mechanism to expand the tube, so that contraction of the expander mechanism contracts the tube and allows the bolt to be pulled out of the bore.

In an alternative arrangement in which the anchor comprises a nut which is fixed to the tendon, and the tendon is threadably engaged with a wedge element of the expander mechanism, the same effect is achieved by rotating the tendon, which will shift one of the wedge elements relative to the other, either expanding or contracting the expander mechanism.

It is to be noted that while reference has been made to the expander mechanism as comprising a pair of wedge elements, it should be appreciated that the expander mechanism can comprise elements that are not wedge elements, for example cam elements, or can comprise an alternative expander construction.

In addition, while the discussion above has been made in relation to a single expander mechanism, it is to be appreciated that more than one expander mechanism could be employed longitudinally within the tube.

Where threaded engagement between the anchor arrangement and the tendon is employed, or between the expander mechanism and the tendon, the extent of relative rotation between the tendon and the anchor arrangement and the expander mechanism can be controlled by limiting the thread length or by the use of abutments or other suitable barriers, such as deformation of the tendon.

The abutment of the anchor can be a plate which extends across the trailing end of the tube. The size of the plate can be such as to overlap the tube end and in that arrangement, the plate can provide support for a ring which is fixed at or adjacent the trailing end of the tube and which is employed to support a rock plate through which the friction bolt extends. In this arrangement, advantageously, the support plate can support the ring when the rock plate is heavily loaded by the rock strata. Thus failure of the ring and thus of the rock plate is less likely to occur.

Other abutment arrangements could be employed. For example, the nut or the barrel and wedge arrangement, could be of a size to abut with the trailing end of the tube so that the support plate becomes redundant, or the trailing end of the tube could be tapered inwardly to a diameter which allows abutment with the nut or the barrel and wedge arrangement. Still alternatively, the abutment might be provided by a plug which is fitted into the trailing end of the tube and that fitment could involve a friction fit, or threaded fit, or any other suitable fitting arrangement. Other suitable forms of anchor are within the scope of the invention.

In one form of the invention, a tube end fitting is employed which substantially closes the trailing end of the tube. Such a fitting could form part of the anchor described above, or could be separate from the anchor. In one form of tube end fitting, the fitting includes a first opening for passage of the elongate tendon and a second opening for passage of a flowable material into the interior of the tube. The flowable material could be a resin or cement grout which is pumped into the interior of the tube for the purpose of preventing compression of the tube under loading from the rock strata. In this arrangement, the inclusion of an internal sleeve as described above is advantageous to facilitate delivery of the flowable material to the leading end of the tube. It does this by forming a passage for the flowable material toward the leading end of the tube. A second passage between the bore wall and the sleeve permits egress of air which is displaced by the flowable material in the first passage. The second passage can include the split in the tube as well as space between the outside of the tube and the bore wall. The inclusion of an internal sleeve as described above can also minimise escape of resin or cement grout from within the tube if the tube does include a longitudinal split.

The use of an end fitting can be such as to provide one of the advantages of the invention, which is to minimise or eliminate the possibility of grout flowing out of the trailing end of the tube when the grout is of a viscosity which is too low. In prior art arrangements, the tube end is often open, leaving a large opening for the grout to flow out of. In this embodiment of the present invention, the trailing tube end is substantially closed, thereby limiting the likelihood of escape of grout through that opening.

Moreover, the use of an end fitting with a second opening for passage of flowable material means that the second opening can be configured to interface with a grout delivery nozzle or the like and so the need to feed a grouting hose to the leading end of the rock bolt is eliminated. Moreover, because grout or resin is pumped into the tube from the trailing end thereof, the tube will be filled by material flowing towards the leading end, and the operator of the grout delivery apparatus will receive an indication that the tube is filled, either because of an increased back pressure in the delivery nozzle, or if an adjustment portion is provided in the wall of the tube and the internal sleeve if provided, then grout or resin will flow rearwardly from the leading end of the tube in a direction towards the rock plate at the trailing end of the tube and the operator will receive a visual indication when the grout or resin appears at the rock plate. Thus, significantly less operator skill is necessary for proper grout delivery to the friction bolt.

The end fitting can be of any suitable material, such as rubber or metal. The end fitting can cooperate with an anchor arrangement, such as a nut. The end fitting can comprise two parts, such as a first rubber plug part and a second metal cover or bell part, the latter of which fits over the rubber end fitting and which is engaged by the nut of an anchor. In this latter arrangement, each of the parts of the end fitting can include openings for passage of the elongate tendon and for passage of a flowable medium. The two parts of the end fitting can be arranged to cooperate, such as through threaded engagement or other connection.

In an end fitting arrangement as discussed above, if an internal sleeve is employed in the friction bolt, the trailing end of the internal sleeve can be arranged to seal with the end fitting so as to seal against egress of flowable material from within the tube. In one arrangement, the end fitting includes a slot into which the trailing end of the internal sleeve can be received. Receipt of the trailing end within the end fitting slot is preferably a snug or tight fit and glue can be employed to further enhance the seal between the internal sleeve and the end fitting.

An alternative use for an end fitting is to properly locate the tendon within the tube. A further alternative use for an end fitting is to frictionally engage the tendon in a manner which resists movement of the tendon that would cause the expander mechanism to expand and hinder installation of the friction bolt into a bore. A single end fitting could be employed for both purposes.

Location of the tendon properly within the tube is expected usually to require concentric location within the tube. Thus, the end fitting can fit within or over the end of the tube and can include a central opening through which the tendon can extend. A non-concentric opening can be provided if non-concentric location of the tendon within the tube is required.

The engagement between the end fitting and the tendon can be loose or a tight frictional engagement. In some arrangements, an increased frictional engagement can be employed to provide the benefit of axially locating the tendon during insertion of a friction bolt into a bore, particularly in cases in which the tube of the friction bolt is of greater outer diameter than the internal diameter of the bore. In such cases, the tube is required to contract radially as it is forced into the bore and for contraction to occur it is important that the expander mechanism be disengaged so that the tube can contract. However, if the tendon is free to move within the tube during installation it may retract or shift in a manner to engage the expander mechanism and so prevent or resist radial contraction of the tube. If frictional engagement of the above kind is employed, axial movement of the tendon can be resisted or prevented thus advantageously preventing inadvertent engagement of the expander mechanism.

If the above frictional engagement between the tendon and the end fitting is adopted, the frictional load applied to the tendon must not be so high as to prevent rotation or axial movement of the tendon as may be required for actuation of the expander mechanism.

The above discussion of the expander mechanism has principally referred to the use of wedge elements in which one wedge element is shifted relative to another to expand the mechanism. In this type of expander mechanism, for most applications, only a small movement of the moveable or "mobile" wedge element will be required to expand the mechanism. However, in some applications, particularly in weak rock, the travel of the mobile wedge element can be greater and potentially could be large enough that the mobile wedge element moves completely past the fixed or stationary wedge element. In that case, the expander mechanism will collapse and provide no expansion load to the tube and so the benefits of including the expansion mechanism will be lost. Accordingly, the invention provides arrangements to limit travel or movement of the mobile wedge element to ensure the wedge elements remain proximate to one another when the expander mechanism is actuated to expand.

In some arrangements where a threaded engagement is employed between the tendon and a nut of the anchor arrangement, the thread length can be selected to limit the extent to which the tendon can be retracted to shift the mobile wedge element. The thread can be terminated to limit tendon retraction, or an abutment can be employed, such as a pin which extends through the tendon.

The same arrangement can be applied where the tendon is in threaded engagement with one of the wedge elements, so that rotation of the tendon is limited to limit the extent of movement of the wedge element.

The present invention also provides an installation tool for installing a friction rock bolt according to the invention and a method of installing a friction rock bolt of that kind.

The installation tool includes a socket which is arranged to apply a percussive load to the trailing end of a friction bolt according to the invention to drive the friction bolt into a bore which has been drilled into a rock wall. The socket includes an opening for receiving the trailing end of the tendon and a drive surface about the opening for applying the percussive load. The depth of the socket opening is sufficient for the drive surface to engage the trailing end of the friction bolt without percussively engaging the tendon.

It will be appreciated that the drive surface of the socket can be arranged to percussively engage any suitable part of the trailing end of the friction bolt. Thus, the drive surface could engage a facing surface of the trailing end of the tube of the friction bolt, or of an end plate which overlies the tube end, or any other suitable friction bolt surface. For example, the drive surface could engage the facing surface of a nut which is attached or fixed to the trailing end of the tendon, so that percussive load could be applied just to the nut, or additionally to the nut as well as to another surface or surfaces of the trailing end of the friction bolt. In this arrangement, percussive load could be applied to the nut and to the trailing end of the tube of the friction bolt or to an end plate that overlies the trailing end.

The opening of the socket can be formed to accept the trailing end of the tendon and, if provided, a nut which is attached to or fixed to the trailing end of the tendon. Where a nut is attached to or fixed to the trailing end of the tendon the opening can be stepped to have a first portion of a diameter to accept the trailing end of the tendon and a second portion of a larger diameter to accept the nut which is attached to or fixed to the trailing end of the tendon. The nut can be a square nut or a hex nut or other shaped nut, and the second portion can have an internal surface complementary to the nut shape.

Between the first and second portions of the opening, a shoulder can be formed. While that shoulder can be employed to impart a percussive load to a facing surface of the nut, if such a load is not required, the shoulder can be positioned so that upon engagement of the drive surface of the socket with the trailing end of the friction bolt, the shoulder is spaced from engagement with the nut. Likewise, the inner end of the socket opening can be spaced from the facing end surface of the tendon upon engagement of the drive surface of the socket with the trailing end of the friction bolt.

The socket can be arranged to apply a biasing load to the tendon and/or the nut attached or fixed to the trailing end of the tendon, so that during percussive drive of the friction bolt by the socket, the tendon can be maintained in a position in which the expander mechanism is disengaged so that if necessary, the tube of the friction bolt can contract radially as it is driven into a bore of reduced diameter compared to the outside diameter of the tube. Moreover, the biasing arrangement can be used to prevent rattling movement of the tendon during drive of the friction bolt.

The biasing arrangement can comprise a coil spring that acts on the trailing end of the tendon, such as on the end face of the tendon, or it can be a rubber or a resilient polymer or the like. The biasing arrangement can also act on the inner end of the socket opening. The biasing arrangement can be secured to the inner end of the socket opening in any suitable manner, such as by a screw that extends into the socket opening through the side wall of the socket.

The method of installing a friction bolt according to the invention thus comprises drilling a bore into a rock wall, inserting the leading end of the friction bolt into the opening of the bore or aligning the leading end of the friction bolt with the opening of the bore, applying a socket to the trailing end of the friction bolt, the socket having an opening for receiving the trailing end of a tendon of the friction bolt and a drive surface for engaging the trailing end of the friction bolt, and driving the socket percussively to drive the friction bolt into the bore.

The method can involve drilling a bore of an internal diameter which is less than the external diameter of the friction bolt tube so that the tube is forced to contract as the friction bolt is driven into the bore.

For a better understanding of the invention and to show how it may be performed, embodiments thereof will now be described, by way of non-limiting example only, with reference to the accompanying drawings.

DETAILED DESCRIPTION OF THE DRAWINGS

Figure 1:
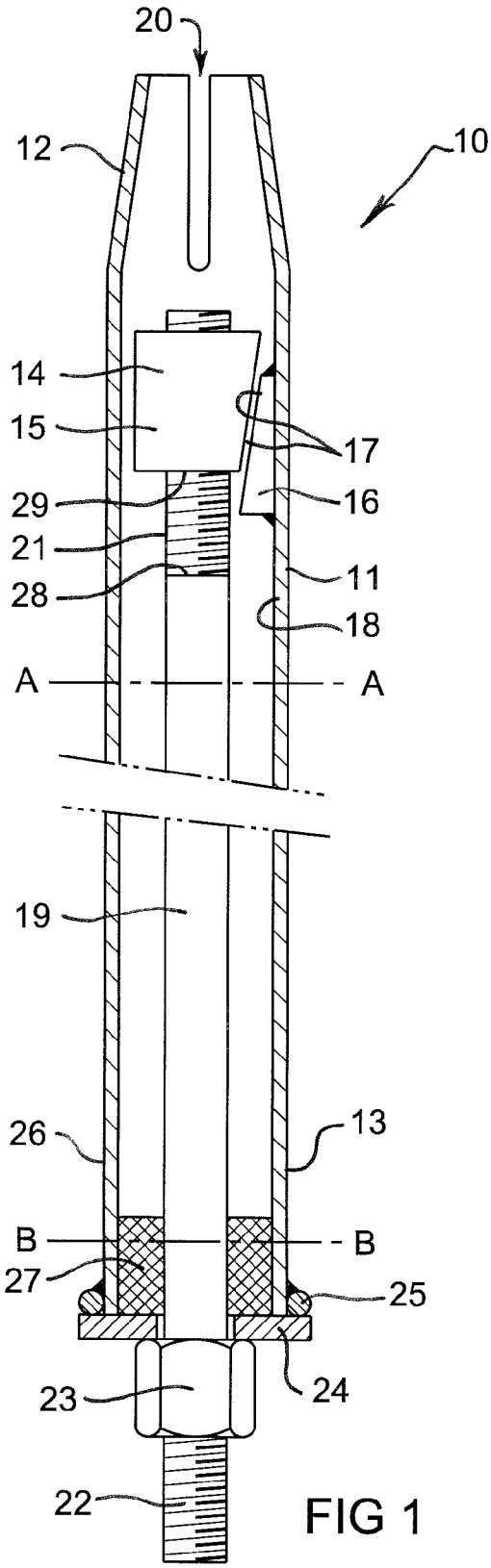
FIG. 1 is a sectioned view of a friction rock bolt according to the present invention.

FIG. 1 is a cross-sectional view of a friction rock bolt according to one embodiment of the invention. The rock bolt 10 includes an elongate generally circular tube 11 having a leading end 12 and a trailing end 13. The length of a typical rock bolt can in the range of about 1 m to about 5 m.

Figure 1A:
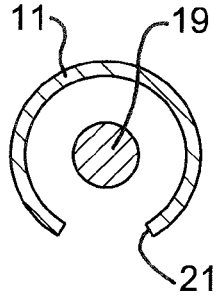
FIG. 1A is a cross-sectional view through AA of FIG. 1.

The tube 11 is split longitudinally along its full length. FIG. 1A is a cross-sectional view of the tube 11 showing the split 21.

An expander mechanism 14 is disposed within the tube 11 and comprises a pair of wedge elements 15, 16 which interface along inclined surfaces 17. The wedge element 16 is fixed to the internal surface 18 of the tube 11 at the leading end 12 of the tube 11 by welding, while the wedge element 15 is secured by threaded engagement to the leading end of an elongate tendon 19. The tendon 19 can be a rigid metal rod or bar, or it can be a cable. It will be easily understood, that relative movement between the wedge elements 15 and 16 will result in either contraction or expansion of the expander mechanism 14, depending on the direction of relative movement. Movement of the wedge element 15 in a direction toward the trailing end 13 of the tube 11 will result in expansion of the expander mechanism 14.

The leading end 12 of the tube 11 is tapered to facilitate insertion of the rock bolt 10 into a bore drilled into a rock face. The end 12 includes two slits on opposite sides thereof, however only one slit 20 is visible in FIG. 1. The slits facilitate compression of the leading end 12 if necessary for insertion into the bore.

The tendon 19 extends beyond the trailing end 13 of the tube 11 and includes threaded ends 21 and 22. A hex nut 23 is fixed to the tendon 19 adjacent the threaded end 22.

The nut 23 is fixed to the tendon 19 so that rotation of the nut 23 rotates the tendon 19. The nut 23 can be fixed to the tendon 19 by crimping or welding or any other suitable fixing arrangement.

Rotation of the nut 23 rotates the tendon 19 so that the wedge element 15 shifts axially on the threaded end 21. Sufficient axial shifting of the wedge element 15 will bring the inclined surfaces 17 together and will impose an expansion load against the internal surface 18 of the tube 11.

The nut 23 is one part of an anchor, which also comprises an abutment in the form of an end plate 24. The end plate 24 overlies the open trailing end 13 of the tube 11 and extends in proximity to a ring 25 which is welded to the outer surface 26 of the tube 11. When installed, the ring 25 abuts against a rock plate (not shown) to secure the rock plate against a rock wall surface and when the rock bolt is under heavy load, the end plate 24 provides additional support to the ring 25 to resist the load applied to the rock plate. Thus the ring 25 is supported against failure by the end plate 24.

The rock bolt 10 further includes an end fitting 27 which is formed as a plug or bush which is fitted into the open trailing end 13 of the bolt 10. The end fitting 27 can be a plastic or rubber bush and is intended to be a friction fit against the internal surface 18 of the tube 11. The end fitting 27 includes a central opening through which the tendon 19 extends and the size of the opening is intended to generate a friction fit against the external surface of the tendon 19.

The function of the end fitting 27 is two-fold. Firstly, the end fitting 27 maintains the anchor end of the tendon 19 concentric with the tube 11. Thus, the tube 11 is restricted against lateral or radial movement relative to the tube 11. The concentric location of the tendon 19 also maintains the end plate 24 concentrically located across the open trailing end 13 of the tube 11 so that the end plate 24 maintains its position extending across the open trailing end 13 of the tube 11 for support of the ring 25.

In addition, the end fitting 27 frictionally engages the tendon 19 so that axial movement of the tendon 19 is resisted during insertion of the rock bolt 10 into a bore. This is important to ensure that the tendon 19 does not move axially in the direction toward the trailing end 13 resulting in engagement between the wedge elements 15 and 16 and preventing radial contraction of the tube 11 as it is inserted into a bore. As explained above, often rock bolts are inserted into a bore which has an internal diameter less than the external diameter of the bolt, so that the outer diameter of the bolt must contract to allow insertion of the rock bolt into the bore. By maintaining the tendon 19 in the position shown in FIG. 1, the wedge elements are maintained spaced apart and the tube 11 can contract where the bolt 10 is inserted into a bore of reduced diameter.

The advantage of the end fitting 27 is that it is a simple and inexpensive component, but it provides significant advantages in the operation of the bolt 10.

Figure 1B:
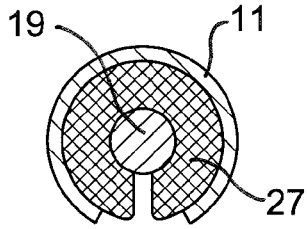
FIG. 1B is a cross-sectional view through BB of FIG. 1.

With reference to FIG. 1*b*, a cross sectional view through section B-B is illustrated, which shows the end fitting 27 in frictional engagement with both the tube 11 and the tendon 19.

It is to be noted that the threaded end 22 of the tendon 19 extends beyond the nut 23 and that is provided for the attachment of auxiliary rock support such as wire mesh. Such wire mesh can extend between adjacent bolts and is provided to capture rock fragments which are dislodged from a rock wall, rather than allowing the fragments to fall as falling rock can present a danger to workers working proximate the rock wall.

While the rock bolt 10 of FIG. 1 is not shown as including an internal sleeve, such a sleeve could be included if considered appropriate. The addition of an internal sleeve, such as that shown by reference numeral 51 in FIGS. 5 to 7, or reference numeral 71 in FIGS. 8 and 9 in the rock bolt 10 can present a barrier to the ingress of water into the interior of the tube 11, so as to protect the tendon 19 against water or moisture.

The rock bolt 10 provides various advantages over prior art bolts as previously indicated herein, but in particular, the rock bolt 10 provides efficient anchoring of the leading end 12 within a bore, while the shear and tensile strength of the bolt is increased by the inclusion of the tendon 19. Additionally, the attachment of the tendon to the expander mechanism significantly improves the tensile strength of the friction bolt and to a lesser extent the shear strength, compared to prior art bolts in which a rod is simply inserted into the interior of the tube after grout has been introduced. Advantages provided by the addition of the end plate 24 have been discussed above.

Figure 2:
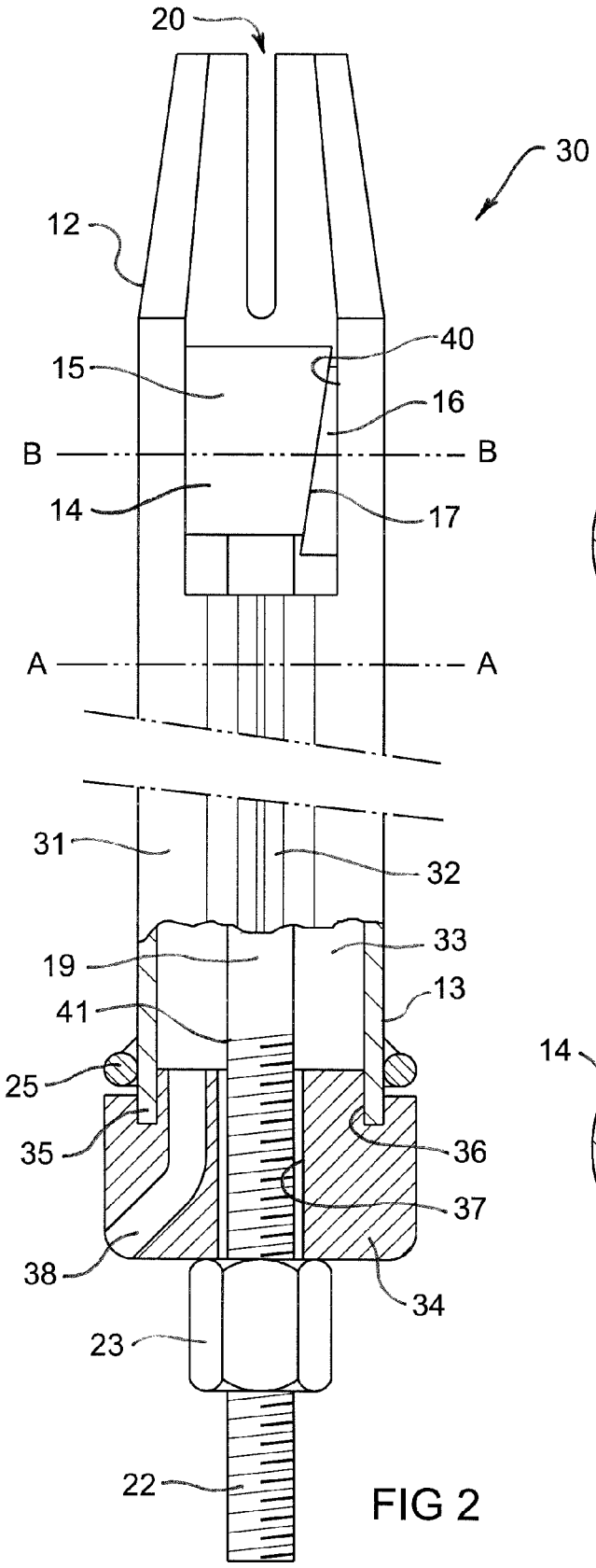
FIG. 2 is a partially sectioned view of another friction rock bolt according to the present invention.
Figure 3:
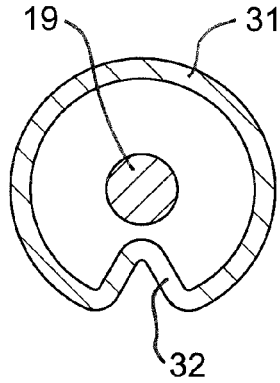
FIG. 3 is a cross-sectional view through AA of FIG. 2.
Figure 4:
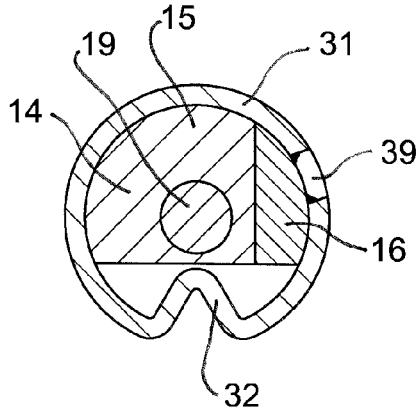
FIG. 4 is cross-sectional view through BB of FIG. 2.

FIG. 2 is a part side and part cross-sectional view of a rock bolt 30 according to another embodiment of the invention. FIG. 3 is a cross-section taken through the rock bolt 30 through A-A, while FIG. 4 is a cross-section taken through the rock bolt 30 through B-B. The rock bolt 30 includes many of the features of the rock bolt 10 of FIG. 1, and therefore the same reference numerals have been employed to identify the same features.

The rock bolt 30 includes an elongate tube 31 which is closed longitudinally as shown in the cross-sectional view in FIGS. 3 and 4. The tube 31 includes an adjustment portion 32 which is formed as an inwardly extending generally V-shaped portion. While the adjustment portion 32 can extend for only a portion of the length of the tube 31, the preference is that it extends fully along the length. It will be evident to a person skilled in the art, that upon expansion radially of the tube 31, the adjustment portion 32 will expand and will shallow out, whilst when the tube 31 is contracted, the adjustment portion 32 will contract and will deepen.

In the rock bolt 30, an alternative arrangement is provided for engagement of the expander mechanism 14. In the rock bolt 10, the nut 23 is fixed to the tendon 19, so that upon rotation of the nut 23, the tendon 19 is also rotated. That rotation was relative to the wedge element 15 which is threadably connected to the tendon 19, so that upon rotation of the tendon 19, the wedge element 15 was caused to move axially within the tube.

In contrast, in FIG. 2, the nut 23 is threaded to the tendon 19, while the wedge element 14 is fixed to the tendon 19. In this arrangement, rotation of the nut 23 is relative to the tendon 19 and causes axial movement of the tendon 19. With that axial movement, the wedge element 14 also moves axially.

In each of the rock bolts 10 and 30, a control mechanism is provided to ensure that axial movement of the wedge element 15 towards the trailing end 13 of the bolt is not so great as to completely pass the fixed wedge element 16. With reference to FIG. 1, the shoulder 28 of the tendon 19 represents the maximum travel of the wedge element 14 along the tendon 19. Accordingly, when the bottom end 29 of the wedge element 15 engages the shoulder 28, no further axial movement of the wedge element 15 towards the trailing end 13 can take place. Accordingly, even though further expansion of the tube 11 might be available, the expander mechanism 14 will not produce further expansion load.

In respect of the rock bolt 30, the threaded end 22 extends to a non-threaded portion 41 at which point the minor diameter of the threaded portion 22 is smaller than the outside diameter of the portion 41. By this arrangement, when the nut 23 reaches the portion 41, the nut 23 cannot rotate any further and therefore further axial movement of the tendon 19 is terminated.

Figure 5:
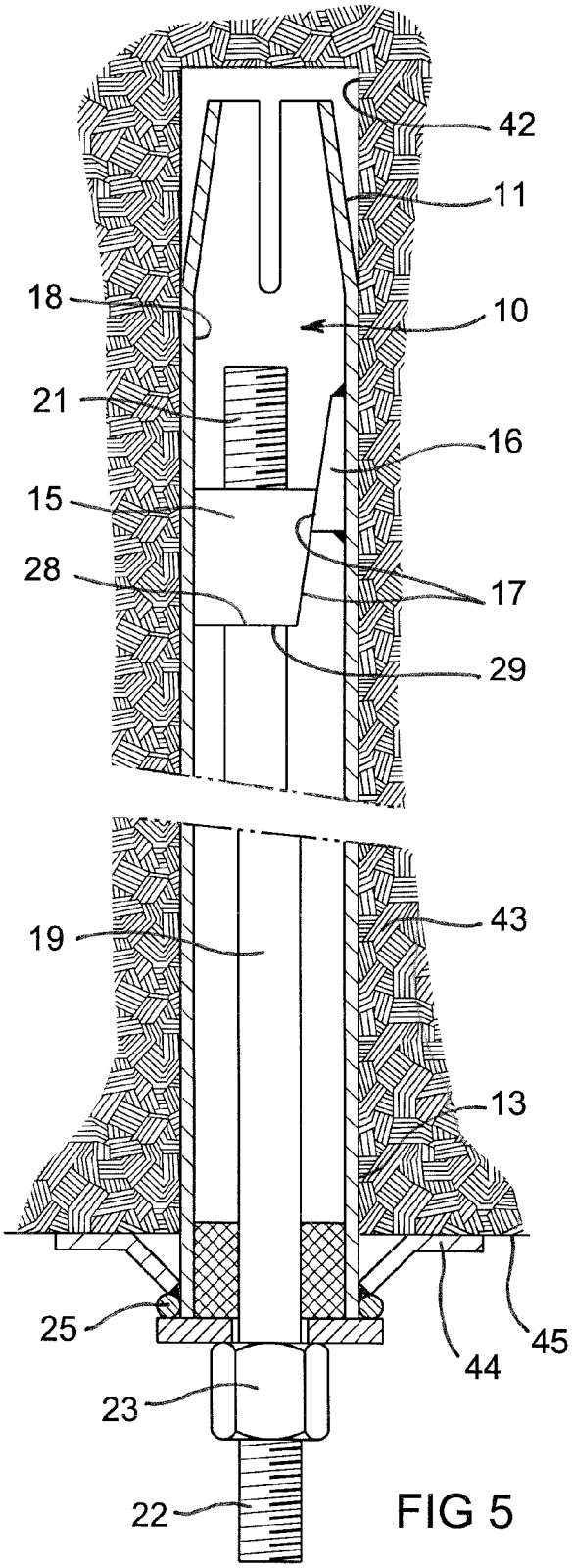
FIG. 5 is a cross-sectional view of the friction rock bolt of FIG. 1 as installed in a bore.

FIG. 5 shows the rock bolt 10 of FIG. 1 in an installed condition within a bore 42 in a body of rock 43. A rock plate 44 is secured between the ring 25 of the bolt 10 and the rock face 45, while it can be seen that the wedge elements 15 and 16 of the expander mechanism 14 have been shifted relative to each other so that the inclined surfaces 17 of the respective elements 15 and 16 are in engagement. It will be evident from FIG. 5, that the nut 23 has not shifted relative to the tendon 19, but rather, rotation of the nut 23 has rotated the tendon 19 and that has shifted the wedge element 15 on the threaded end 21. Thus, the wedge element 15 has shifted downwardly in the view of FIG. 5 relative to the fixed wedge element 16 so that a radial expansion load has been applied to the internal surface 18 of the tube 11.

It will further be evident, that the bottom edge 29 of the wedge element 15 has reached the shoulder 28 of the tendon 19, at the end of the threaded end 21, so that no further movement of the wedge element 15 on the tendon 19 is available. By this mechanism, the wedge element 15 is able to move only to the position in FIG. 5 and no further. Thus, the mechanism provides that the wedge elements 15 and 16 always remain in engagement and prevents the wedge element 15 from moving past the wedge element 16 in the direction of the trailing end 13 of the bolt.

In a rock bolt 30 of FIG. 2, post grouting of the bolt can be achieved by pumping grout into the interior 33 of the tube 31. To facilitate insertion of grout into the interior 33, the rock bolt 30 includes an end fitting 34 which is fitted over the trailing end of the tube 31 by the tube end 35 fitting into a slot 36 formed in the end fitting 34. The tube end 35 can fit into the slot 36 by frictional engagement, or a threaded or other suitable engagement can be provided.

The fitting 34 can locate the tendon 19 concentrically within the tube 11 at the trailing end 13 and can frictionally engage the tendon 19 for the reasons explained in respect of the end fitting 27 of FIG. 1.

The fitting 34 includes a first opening 37 to receive the trailing end of the tendon 19 and a second opening 38 for delivery of grout. A suitable grout delivery device can be employed to interface with the opening 38 for the passage of grout therethrough.

The benefit of post grouting of the rock bolt 30 is that the cured grout resists compression of the tube 31 which tends to occur when the bolt is under the influence of a load that causes the bolt to be pulled out of the bore in which it has been inserted. The method of installation if post grouting is employed is that the bolt 30 is inserted into a bore drilled into the rock strata and thereafter the expander mechanism 13 is activated by rotation of the nut 23 to retract the tendon 19 in a direction towards the trailing end 13 of the tube 31. Once the expander mechanism 14 has been expanded as desired, grout can be pumped into the interior of the tube 31. Once the grout has reached the leading end 12 of the rock bolt 30, the grout can travel toward the trailing end 13 though the adjustment portion 32. That return portion of grout can bond with the wall of the bore into which the rock bolt 30 has been inserted, to increase the hold of the bolt 30 within the bore. Additionally, upon the grout appearing at the trailing end of the rock bolt 30, the operator of the grout delivery device will have visual confirmation of proper grouting of the bolt 30.

FIG. 4 illustrates in cross-section through B-B, how the expander mechanism 14 is accommodated within the tube 31 which is formed with the adjustment portion 32. It can be seen that the wedge elements 15 and 16 are sized and shaped to be accommodated within the interior of the tube 31, inboard of the innermost end of the expansion portion 32. Additionally, FIG. 4 illustrates an opening 39 through which a weld can be applied to the rear surface of the wedge element 16 to fix that surface to the interior surface of the tube 31. Alternatively, an opening 40 (see FIG. 2), can be made in the wall of the tube 31 to provide access for fixing of the wedge element 16, such as by welding the wedge element 16 at opposite ends as shown in FIG. 1. Either of the opening arrangements shown in FIG. 2 or 4 can be adopted, as can be alternative arrangements not illustrated.

Figure 6:
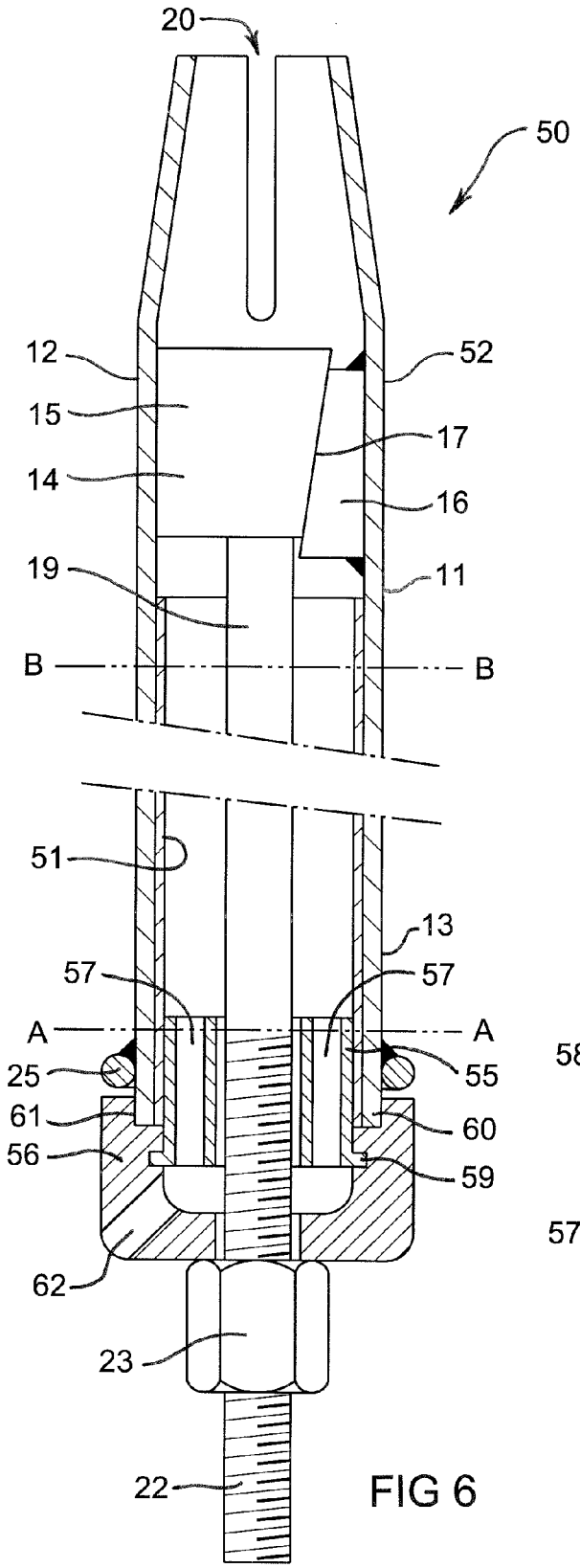
FIG. 6 is a cross-sectional view of another friction rock bolt according to the present invention.

FIG. 6 is a cross-sectional view of a rock bolt 50 according to another embodiment of the invention. The rock bolt 50 differs from the earlier rock bolts 10 and 30, by the inclusion of an interior sleeve 51. Again, features which are common to the rock bolts 10 and 30 maintain the same reference numerals in FIG. 1.

Figure 7:
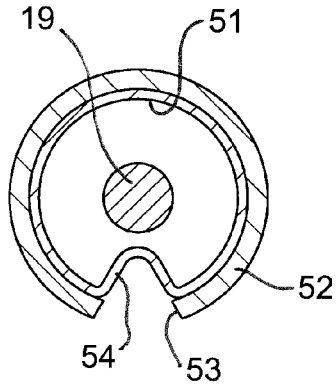
FIG. 7 is a cross-sectional view through BB of FIG. 6.

The rock bolt 50 includes a tube 52 and a longitudinal split 53 (see FIG. 7). The split 53 extends for the full length of the tube 52 and permits the tube 52 to radially expand and contract.

The interior sleeve 51 is generally circular, but includes an adjustment portion 54 which is formed as an inwardly extending generally V-shaped portion. The profile of the interior sleeve 51 is similar to the profile of the closed tube 31 of the rock bolt 30 shown in FIG. 2, therefore the interior sleeve 51 overlies or bridges the split 53 in the tube 52.

The interior sleeve 51 advantageously assists to protect the tendon 19 from corrosion, by preventing access to the tendon, or at least restricting access, to exposure to water or moisture. It will be appreciated from FIG. 6, that the full length of the rock bolt 50 is not shown, and it is to be appreciated that only a small portion of the overall length of the tube 52 does not include the interior sleeve 51. Thus, it is the major portion of the tendon 19 which is protected from exposure to water or moisture by the interior sleeve 51.

Moreover, because the interior sleeve 52 bridges the split 53, cement grout which is pumped into the interior of the rock bolt 50 is substantially prevented from escaping through the split 53. It is the grout which provides the principle protection to the tendon 19 against exposure to water or moisture, while the grout also assists to properly anchor the friction bolt within a bore.

The interior sleeve 51 is preferably of plastic, although any sufficiently flexible material is acceptable provided the adjustment portion 54 of the sleeve 51 can expand and contract with the tube 52 as required.

Figure 8:
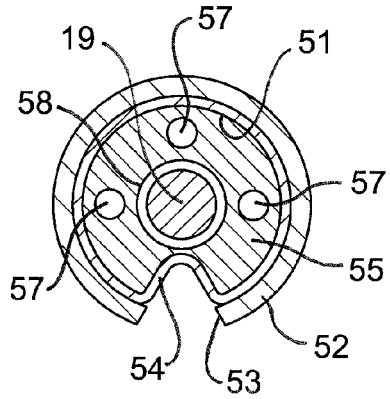
FIG. 8 is a cross-sectional view through AA of FIG. 6.

The rock bolt 50 further includes a tube end fitting for substantially closing the trailing end 13 of the tube 52 and the end fitting illustrated in FIG. 6 is a two-part fitting, which comprises a first plug part 55 and a second cover part 56. FIG. 8 illustrates a cross-sectional view taken through A-A of FIG. 6. As shown in FIGS. 6 and 8, the plug 55 includes three openings 57 for the passage of grout, and a central opening 58 to accommodate passage of the tendon 19. The plug 55 is shown to be a close fit to the interior sleeve 51 and in the preferred arrangement, the fit is a friction fit so that the plug 55 seals against the interior sleeve 51.

The cover 56 interconnects with the plug 55 by the flange 59 being received within a complementary slot in the cover 56 and the cover 56 is attached to the tube end 60 via a step 61. By this arrangement, the cover 56 is centralised on the tube 11, which assists centralisation of the tendon 19. The cover 56 is preferably made from a metallic material.

The cover 56 includes an opening 62 to receive the nozzle of a grout supply device so that grout which is pumped through the opening 62 flows through the openings 57 of the plug 55 and into the interior of the bolt 50.

In other respects, the rock bolts 30 and 50 operate in a similar manner to the rock bolt 10 of FIG. 1, in that the respective rock bolts 30, 50 are inserted into a bore and the expander mechanism 14 is actuated by rotation of the nut 23 relative to the tendon 19. That nut rotation draws the tendon 19 in a direction toward the trailing end 13 of the respective bolts 30, 50 to cause the expander mechanism to expand and for the tube 52 to firmly grip the interior wall of the bore. Thereafter, grout can be inserted through the respective openings 38 and 62 and left to cure.

Figure 9:
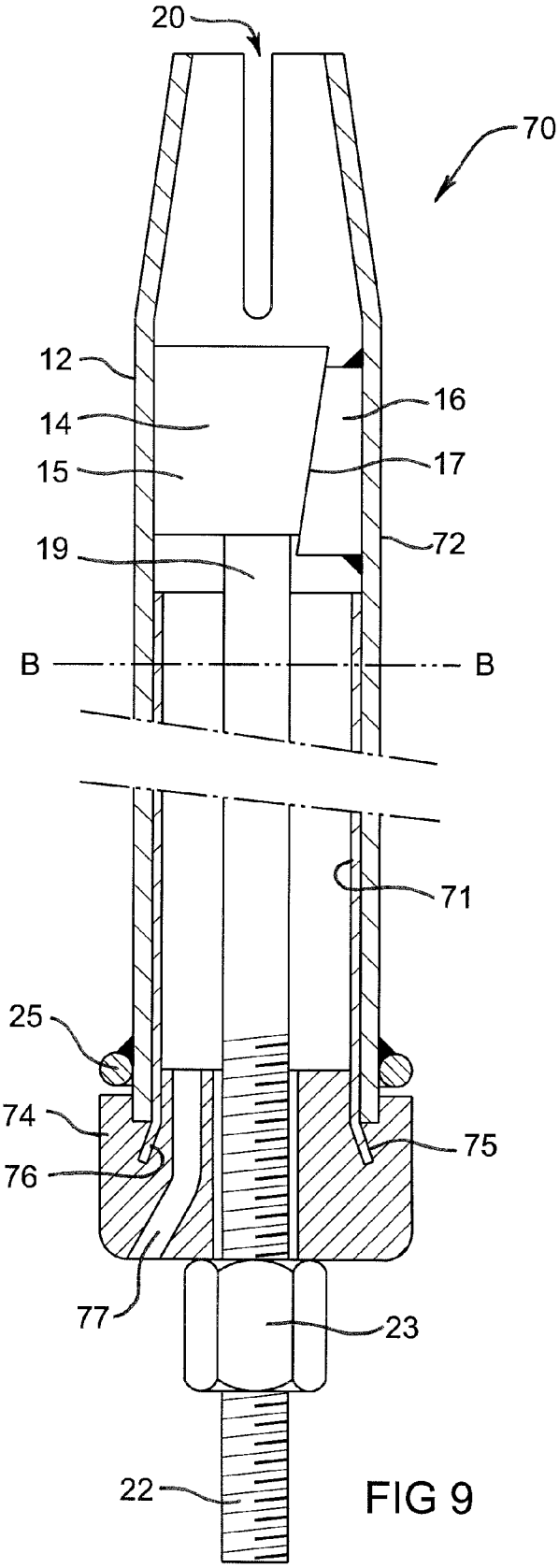
FIG. 9 is a cross-sectional view of another friction rock bolt according to the present invention.

FIG. 9 illustrates a further embodiment of a rock bolt according to the invention. The rock bolt 70 of FIG. 9 is very similar in construction to the rock bolt 50 of FIG. 6, in that the rock bolt 70 includes an interior sleeve 71. Like earlier figures, like parts are given the same reference numerals.

Figure 10:
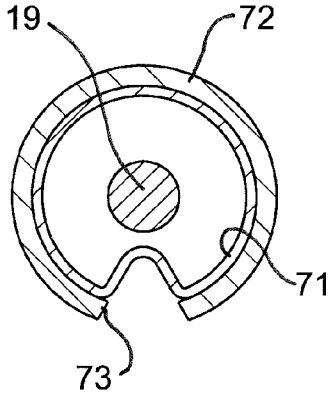
FIG. 10 is a cross-sectional view through BB of FIG. 8.

The rock bolt 70 includes an elongate tube 72 which has a longitudinal split 73 (FIG. 10). The rock bolt 70 further includes an end fitting 74 which is similar to the end fitting 34 of the rock bolt 30, however in the arrangement of FIG. 9, the interior sleeve 71 includes a tapered or flared end 75 that extends into a slot 76 formed in the end fitting 74 in order for the sleeve 71 to seal within the end fitting 74. To improve the seal, an adhesive may be employed within the slot 76.

In other respects, the construction of the rock bolt 70 is similar to the rock bolt 30 of FIG. 2 in that a single part end fitting 74 is provided and grout is pumped through an opening 77 in the end fitting 74 into the interior of the tube 72. The method of insertion and expansion of the expander mechanism 14 is again the same as that described in relation to the rock bolts 30 and 50.

In relation to the introduction of cement grout into the interior of the tube, the grout delivery apparatus can include a cup that interfaces with the grout bell of the figures, rather than employing a nozzle. The cup will deliver grout to feed into the interior of the tube through the opening in the grout bell, for example the openings 38, 62 or 77 of FIGS. 2, 6 and 9.

Figure 11:
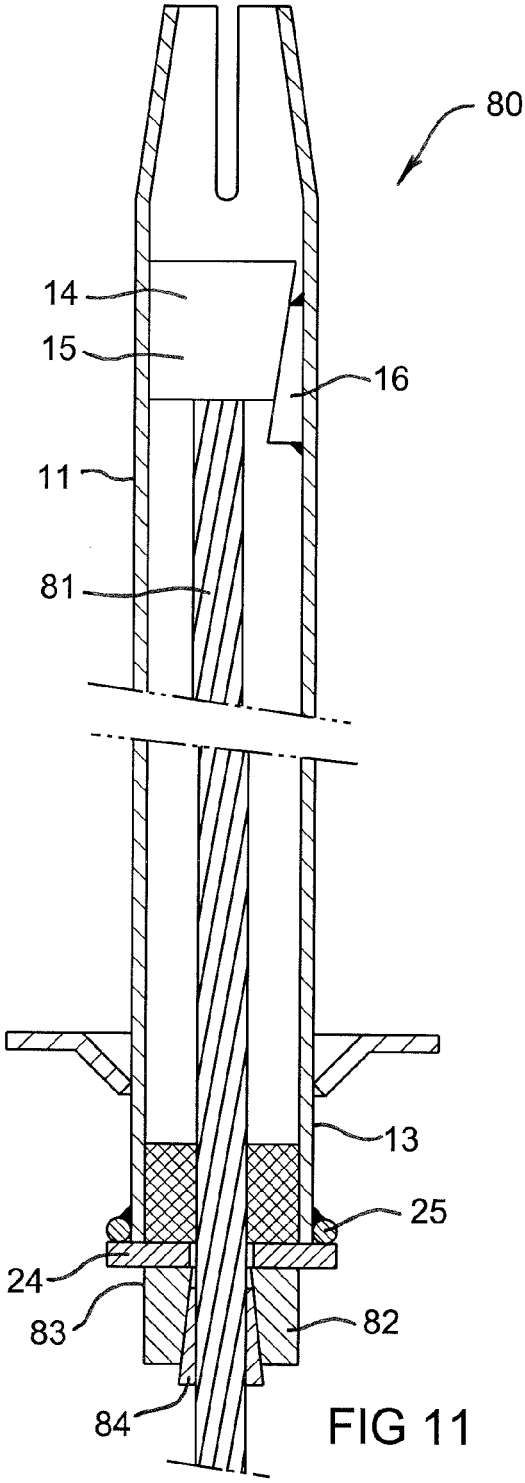
FIG. 11 is a cross-sectional view of another friction rock bolt according to the present invention.

FIG. 11 illustrates a further friction rock bolt 80 which in most respects is very similar to the rock bolt 10 of FIG. 1. Accordingly, for like parts, the same reference numerals have been employed. Where the rock bolt 80 differs from the rock bolt 10, is in respect of the tendon 81, which is in the form of a cable rather than a metal rod or bar, and also in respect of the anchor 82 which is in the form of a barrel and wedges anchor, rather than a anchor of the kind shown in the earlier figures. The anchor 82 thus comprises a barrel 83 and a plurality of wedges 84, through which the cable 81 extends. Engagement of the wedge elements 15 and 16 is by retracting the tendon 81 in the direction of the trailing end 13 of the bolt 80, while return movement of the cable 81 is resisted by engagement of the wedges 84 in the barrel 83.

Figure 12:
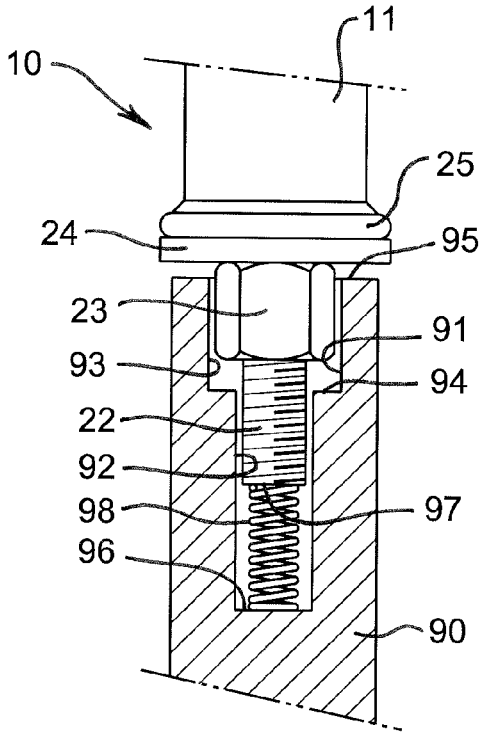
FIG. 12 illustrates in part cross-sectional view, the trailing end of the rock bolt of FIG. 1 with an installation tool attached to the trailing end.

FIG. 12 illustrates in part cross-sectional view, the trailing end of the rock bolt 10 of FIG. 1, with the end fitting 27 omitted, so that FIG. 12 illustrates a tube 11, a ring 25 and an end plate 24. Further illustrated is the threaded end 22 of the tendon 19 (obscured), and the nut 23 which is fixed to the tendon 19.

FIG. 12 further illustrates the socket 90 of an installation tool the remaining components of which are not illustrated. The installation tool, through the socket 90, is arranged to apply a percussive load to the trailing end of the rock bolt 10 in order to insert the rock bolt 10 into a bore which has been drilled into a rock wall. The socket 90 includes an opening 91 which accommodates the threaded end 22 of tendon 19 and the hex nut 23. The opening 91 includes a first portion 92 of a first diameter which is sized to accommodate the trailing end 22, and a hexagonal second portion 93 of a larger diameter which is sized to accommodate the nut 23. A shoulder 94 is formed at the junction between the first and second portions 92 and 93.

The socket 90 further includes a drive surface 95, which is a hexagonal surface that completely surrounds the nut 23. The drive surface 95 is intended to apply a percussive drive load to the facing surface of the end plate 24 in order to drive the rock bolt 10 into a bore which has been drilled in a rock wall.

In the FIG. 12 illustration, the drive surface 95 is intended to provide the only contact with the rock bolt 10 for driving of the bolt into a bore. Thus, the space between the drive surface 95 and the facing surface of the end plate 24 is required to be smaller than the space between the shoulder 94 and the facing surface of the nut 23. In addition, the inner end 96 of the opening 92 is required to be spaced from the facing end 97 of the threaded end 22. By that arrangement, when the socket 90 is driven percussively, the only drive contact between the socket 90 and the rock bolt 10 is between the drive surface 95 and the facing surface of the end plate 24.

Disposed within the opening 92 is a coil spring 98, although it is expected that in practice, the spring 98 will be a rubber or resilient polymer block or part. The spring is fixed to the inner end 96 of the socket 90 in any suitable manner such as by a screw (not shown) that extends through the wall of the socket, and the opposite end of the spring 98 engages against the facing end 97 of the threaded end 22. By this arrangement, the spring 98 applies a biasing load to the threaded end 22 so that the nut 23 remains in contact with the end plate 24 during drive of the rock bolt 10 into a hole. Advantageously, by this arrangement, the tendon 19 is retained in a position in which the expander mechanism is disengaged, so that resistance to radial contraction of the tube 11 of the rock bolt 10 is eliminated as the rock bolt is inserted into a bore. The biasing influence provided by the spring 98 is also effective to prevent the tendon 19 from rattling during installation of the rock bolt 10.

The arrangement illustrated in FIG. 12 advantageously reduces loss of energy during drive of a rock bolt into a hole by directly applying the drive to the end plate 24, rather than through the threaded end 22 or the nut 23.

It will be appreciated however, that if drive of the rock bolt 10 is required through engagement not only between the drive surface 95 and the end plate 24, but also between the shoulder 94 and the nut 23, that the dimensions of the socket 90 can be altered so that simultaneous engagement is provided.

The invention described herein is susceptible to variations, modifications and/or additions other than those specifically described and it is to be understood that the invention includes all such variations, modifications and/or additions which fall within the spirit and scope of the above description.

The disclosures in Australian provisional patent application Nos. 2009901030 and 2009901031, from which this application claims priority, are incorporated herein by reference.

The invention claimed is:

1. A friction bolt, for frictionally engaging the internal surface of a bore drilled into a rock face, the friction bolt comprising:

an elongate, generally circular tube which is expandable radially, the tube having a leading end and a trailing end, an expander mechanism disposed within the tube for applying a load tending to expand at least a section of the tube radially, an elongate tendon disposed longitudinally within the tube and in connection at or towards one end of the tendon with the expander mechanism and in connection at or towards an opposite end of the tendon with an anchor arrangement, the tendon being actuatable to expand the expander mechanism and to remain connected between the expander mechanism and the anchor arrangement while the expander mechanism is expanded, and an end fitting at the trailing end of the tube, the end fitting including a central opening through which the tendon extends, the opening being sized to frictionally engage the outer surface of the tendon to resist axial movement of the tendon within the tube and to position the anchor end of the tendon concentric with the tube, wherein the expander mechanism comprises a pair of expander elements, a first of which is secured relative to the tube and a second of which is secured to the elongate tendon, actuation of the tendon being operable to cause relative movement between the first and second expander elements to cause the expander mechanism to expand.

2. A friction bolt according to claim 1, wherein the tube is split longitudinally along at least a portion of its length and whereby radial expansion of the tube is facilitated by lateral expansion of the longitudinal split.

3. A friction bolt according to claim 2, wherein the tube is split longitudinally fully along its length.

4. A friction bolt according to claim 1, wherein the tube is closed longitudinally and includes an expansion portion along at least a portion of its length to permit radial expansion of the tube when the expander mechanism is actuated to expand the tube.

5. A friction bolt according to claim 4, wherein the expansion portion permits radial contraction of the tube for insertion of the friction bolt into a bore.

6. A friction bolt according to claim 1, wherein the first and second expander elements are wedge elements and whereby actuation of the tendon causes the second wedge element to move relative to the first wedge element.

7. A friction bolt according to claim 6, the second expander element being secured to the tendon by a threaded connection, whereby actuation of the tendon is by rotation of the tendon relative to the second expander element to cause the second expander element to shift on the threaded connection.

8. A friction bolt according to claim 7, the second expander element being secured to the tendon by a fixed connection, whereby actuation of the tendon is by retraction of the tendon which results in complementary retraction of the second expander element.

9. A friction bolt according to claim 8, the tendon having a threaded end remote from the second expander element and the anchor includes a nut in threaded connection with the threaded end and an abutment against which the nut abuts, whereby retraction of the tendon is by rotation of the nut on the threaded end.

10. A friction bolt according to claim 9, wherein the abutment is a plate that extends across the trailing end of the tube.

11. A friction bolt according to claim 1, wherein the elongate tendon is a rigid bar.

12. A friction bolt according to 11, wherein the rigid bar is a hollow bar.

13. A friction bolt according to claim 1, wherein the elongate tendon is a cable.

14. A friction bolt according to claim 1, wherein the leading end of the tube is tapered.

15. A friction bolt according to claim 14, wherein the tapered sides of the leading end of the tube include two slits located radially opposite each other.

16. A friction bolt according to claim 1, wherein the end fitting frictionally engages the internal surface of the tube.

17. A friction bolt according to claim 1, wherein the end fitting includes a second opening for passage of flowable medium into the interior of the tube.

18. A method of installing a friction bolt according to claim 1, the method including drilling a bore into a rock face, inserting the rock bolt into the bore and expanding the expander mechanism.

19. A method according to claim 18, including introducing cement grout into the tube of the rock bolt after the expander mechanism has been expanded.

20. A method of installing a friction bolt according to claim 1, comprising drilling a bore into a rock wall, inserting the leading end of the friction bolt into the opening of the bore or aligning the leading end of the friction bolt with the opening of the bore, applying a socket to the trailing end of the friction bolt, the socket having an opening for receiving the trailing end of a tendon of the friction bolt and a drive surface for engaging the trailing end of the friction bolt, and driving the socket percussively to drive the friction bolt into the bore by engagement of the drive surface with the trailing end of the friction bolt.

21. A method according to claim 20, including drilling a bore of an internal diameter which is less than the external diameter of the friction bolt and driving the friction bolt into the bore so that the friction bolt is forced to contract radially as it is driven into the bore.

22. A friction bolt for frictionally engaging the internal surface of a bore drilled into a rock face, the friction bolt comprising:

an elongate, generally circular tube which is expandable radially, the tube having a leading end and a trailing end, an expander mechanism disposed within the tube for applying a load tending to expand at least a section of the tube radially, and an elongate tendon disposed longitudinally within the tube and in connection at or towards one end of the tendon with the expander mechanism and in connection at or towards an opposite end of the tendon with an anchor arrangement, the tendon being actuatable to expand the expander mechanism and to remain connected between the expander mechanism and the anchor arrangement while the expander mechanism is expanded, wherein the expander mechanism comprises a pair of expander elements, a first of which is secured relative to the tube and a second of which is secured to the elongate tendon, actuation of the tendon being operable to cause relative movement between the first and second expander elements to cause the expander mechanism to expand, wherein the tube is split longitudinally along at least a portion of its length and whereby radial expansion of the tube is facilitated by lateral expansion of the longitudinal split, and wherein the friction bolt further includes an elongate internal sleeve disposed within the tube and in resting engagement with the internal surface of the tube, the internal sleeve bridging the longitudinal split and extending for substantially the length of the split.

23. A friction bolt according to claim 22, wherein the internal sleeve is closed longitudinally and includes an expansion portion along at least a portion of its length to allow the internal sleeve to expand radially when the expander mechanism is actuated to expand the tube.

24. A friction bolt according to claim 23, wherein the expansion portion of the internal sleeve permits radial contraction of the internal sleeve upon radial contraction of the tube for insertion of the friction bolt into a bore.

25. A friction bolt installation tool, the tool including:

a socket which is arranged to apply a percussive load to a trailing end of a friction bolt to drive the friction bolt into a bore which has been drilled into a rock wall, wherein the socket includes an opening for receiving a trailing end of a tendon of the friction bolt and a drive surface about the opening for applying the percussive load, wherein a depth of the opening is sufficient for the drive surface to engage the trailing end of the friction bolt without percussively engaging the tendon of the friction bolt, and wherein the friction bolt installation tool further includes a biasing arrangement to apply a biasing load to the tendon of the friction bolt to maintain an expander mechanism of the friction bolt in a disengaged condition during driving of the friction bolt into the bore.

26. An installation tool according to claim 25, the opening of the socket being formed to accept the trailing end of the tendon and a nut which is attached to or fixed to the trailing end of the tendon.

27. An installation tool according to claim 26, the opening being stepped to have a first portion of a diameter to accept the trailing end of the tendon and a second portion of a larger diameter to accept the nut which is attached to or fixed to the trailing end of the tendon.

28. An installation tool according to claim 27, a shoulder being formed between the first and second portions of the opening and the shoulder being positioned so that upon engagement of the drive surface of the socket with the trailing end of the friction bolt, the shoulder is spaced from engagement with the nut.

29. An installation tool according to claim 25, the biasing arrangement comprising a coil spring, rubber or resilient polymer.

* * * * *